US005081813A

United States Patent [19]

White

[11] Patent Number: 5,081,813

[45] Date of Patent: Jan. 21, 1992

[54] METAL WALL FRAME STRUCTURE

[75] Inventor: Stanley B. White, Mt. Ousley, Australia

[73] Assignee: Allied Constructions Pty. Limited, New South Wales, Australia

[21] Appl. No.: 485,715

[22] Filed: Feb. 27, 1990

[51] Int. Cl.[5] ..... E04B 2/60; E04C 2/38

[52] U.S. Cl. ..... 52/656; 52/241; 52/665

[58] Field of Search ..... 52/241, 242, 243, 665, 52/656

[56] References Cited

U.S. PATENT DOCUMENTS

| | | |
|---|---|---|
| 2,105,771 | 1/1937 | Holdsworth . |
| 3,332,188 | 7/1967 | Schaefer . |
| 3,536,345 | 10/1970 | Leifer . |
| 3,680,271 | 8/1972 | Satchell . |
| 3,845,601 | 11/1974 | Kostecky . |
| 4,757,657 | 7/1988 | Mitchell . |

FOREIGN PATENT DOCUMENTS

| | | |
|---|---|---|
| 587047 | 10/1944 | United Kingdom . |
| 2169937 | 5/1988 | United Kingdom . |

OTHER PUBLICATIONS

PCT printed application WO88/10344, 12-1988, 3 pp. of dwg., 5 pp. of spec.

*Primary Examiner*—John E. Murtagh

*Attorney, Agent, or Firm*—Armstrong, Nikaido, Marmelstein, Kubovcik & Murray

[57] ABSTRACT

A metal wall frame structure for a building which includes a horizontal top plate, a horizontal bottom plate and a number of vertical studs. The top and bottom plates are identical each being of U-shaped channel section, having side walls and a base, and having a plurality of paired inwardly directed tabs arrayed along each of the side walls. The studs each are of a U-shaped section having side walls and a base. The studs are of such a width that their ends nest neatly within the plates. The wall frame structure is characterized in that each stud is adapted to be nested in a plate between two adjacent pairs of tabs or around a single pair of tabs, or both. Each stud has adjacent at least one end and adjacent to each side wall at least a pair of aligned apertures aligned transversely to the axis of the stud. A pin extends through each end pair of aligned apertures in the stud and engages against the side of an associated tab proximal to the base of the associated plate to urge that end of the stud into engagement with the base wall of the adjacent plate.

10 Claims, 4 Drawing Sheets

METAL WALL FRAME STRUCTURE

BACKGROUND OF THE INVENTION

The present invention relates to a metal wall frame structure such as may be used for domestic dwelling constructions and for partitioning in public and commercial buildings.

It has been frequently proposed in the past to form wall frame structures from rolled steel members. Such frame structures generally comprise a horizontally disposed top plate, a horizontally disposed bottom plate and a plurality of vertically extending wall studs interconnecting the top and bottom plates. The plates are of a generally U-shaped section and the studs are of a generally U-shaped section and are of a width such that their ends may be nested within the channel defined by the plates. These various prior art proposals have generally differed from one another in the manner in which the studs and plates are connected together or in the manner of construction of the wall frame structure, the two being inter-related.

Wall frame structures have either been constructed from factory produced panels or sub-assemblies which have been transported to site or have been fully assembled on site from basic components. Welded or riveted stud to plate connections have generally been used in factory produced panels, such connections being economically made under factory conditions and the rigidity derived therefrom being essential to the practicality of the method of construction. Various interlock type stud to plate connections have been developed for field assembly from basic components. All interlock connections have had a degree of looseness which is taken up in the final bracing of the wall frame structure.

However the looseness in such connections makes them unsuitable for construction using off-site assembled panels because of the need for excessive bracing.

SUMMARY OF THE INVENTION

An objective of this invention is to provide an alternative to known systems and, in preferred embodiments, to provide a rigid interlock type stud to plate connection which, because of its rigidity, will reduce the extent of bracing required in frames assembled in the field from basic components and which will also be adaptable to construction using off-site assembled panels or sub-assemblies.

The present invention consists in a metal wall frame structure which comprises a horizontally disposed top plate, a horizontally disposed bottom plate, and a plurality of vertically extending wall studs interconnecting the top and bottom plates; the top and bottom plates being substantially identical and each being in the form of a generally U-shaped channel having side walls, a base wall which interconnects the side walls and a plurality of paired inwardly directed tabs arrayed along each of the side walls; the studs each having a generally U-shaped section which has side walls and a base wall which interconnects the side walls and which has a width approximately equal to the spacing between the side walls of the plates whereby the terminal ends of the studs may be nested within the channels defined by the plates, characterised in that each stud is adapted to be nested between two adjacent pairs of tabs or around a single pair of tabs, or both, each stud having adjacent at least one end and adjacent to each side wall at least a pair of apertures aligned transversely to the axis of the stud, and locking means comprising a pin extending through each pair of aligned apertures in the stud and engaging against the side of an associated tab or tabs proximal to the base wall of the associated plate to urge the said end of the stud into contact with the base wall of the adjacent plate.

The studs are preferably each of a C-shaped cross section with each of the side walls carrying, on its edge distal to the base wall, an inwardly directed flange. In this case the aligned apertures are formed on each side of the stud through the flange and through the base wall of the stud as well as through any intermediate corrugations in the side wall of the stud. In this embodiment of the invention the stud is nested between two adjacent pairs of tabs. The pins will then each extend beneath the adjacent tabs on one side wall of the plate and through the adjacent apertures in the flange and the base wall to urge the end of the stud against the base wall of the adjacent plate.

In another embodiment of the invention each side wall of each stud is formed, at least adjacent each end, with an inwardly extending longitudinal corrugation. The corrugations are so dimensioned that a tab will neatly nest within each corrugation. In this embodiment the apertures may be only formed on either side of the corrugation such that each pin will extend through the apertures and beneath the tab positioned between them to urge the end of the stud into contact with the associated plate. Preferably each side wall will include only a single, longitudinally extending, corrugation however it is possible to form each side wall of greater width and to form in it a plurality of corrugations.

The studs are preferably adjustable along the plates on a pitch equal to the centre to centre spacing of the paired tabs.

The tabs preferably extending inwardly from the edges of the side walls of the plates and have an end portion turned to point towards the base wall of the plate and to lie in a plane parallel to the plane of the side walls to which it is connected. If desired the tabs may extend inwardly from the side wall below its edge distal to the base wall. The locking pins engage also with the inner face of the downturned tab and the inner face of the stud side wall between the aligned apertures securely fixing plate side wall to stud side wall. The confinement of a downturned tab within the stepped profile of the stud side wall gives the connection greater resistance to separation.

In the simplest embodiment of the invention the pins are parallel sided and the aligned apertures are all of substantially the same size. In this embodiment the pins are preferably dimensioned to form an interference fit with all of the aligned apertures. An advantage of using parallel sided pins is that the same pin may be introduced into the aligned apertures from either side of the stud. In other embodiments the pins are either tapered along their length or are of a stepped form getting thinner towards the free end. In either of these cases the size of the various apertures will preferably diminish in the direction in which the pin is to be inserted such that when the pin is fully driven home there will be an interference fit between the pin and each of the aligned apertures. This arrangement has the advantage that there is less frictional resistance to the insertion of the pin until it is finally being driven home.

Substantial advantages flow from the preferred embodiment of the invention. The presence of the pins secures the wall frame structure together during transport allowing the frame to be assembled in a factory and moved in an assembled form to the building site. The corrugations in the side walls of the studs increases the bearing surface between the studs and the base wall of the plates. This has the effect of increasing the rigidity of the structure. In particularly preferred embodiments of the invention a chamfer is provided where the side wall of each stud meets the ends of the studs. This chamfer accommodates the radius almost invariably present between the base wall and the side walls of each of the plates and thus allows the ends of the corrugations to bear directly against the base walls of the plates.

As has been indicated above the tabs preferably extend inwardly from the upper edges of the side walls of the plates and have an end portion turned to point towards the base wall of the plate and to lie in a plane parallel to the plane of side walls to which it is connected. The use of such turned over tabs allows a strengthening rolled steel beam to be slid along the stud to a position in which it can span a window or door opening. The tabs serve to retain and position such a beam in the wall frame structures.

BRIEF DESCRIPTION OF THE DRAWINGS

Hereinafter given by way of example only is a preferred embodiment of the invention described with reference to the accompanying drawings in which.

DETAILED DESCRIPTION OF THE PREFERRED EMBODIMENT

Figure 1:
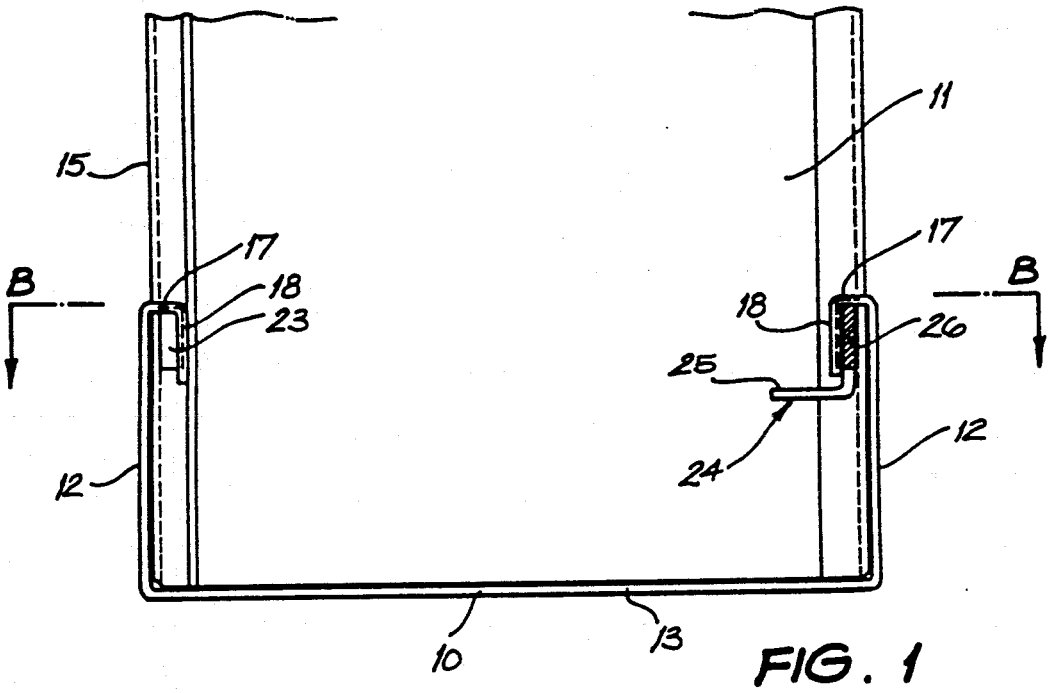
FIG. 1 is a horizontal sectional view of the joint between a stud and a plate forming part of a wall frame structure taken along A—A of FIG. 2.

The bottom plate 10 and the stud 11 shown in FIG. 1 are part of a metal wall framing structure which includes identical top and bottom plates interconnected by a plurality of studs identical with stud 11. The plate 10 is of U-shaped sections and comprises a pair of side walls 12 and a base wall 13 interconnecting the side walls 12. The stud 11 is of substantially C-shaped cross sections comprising a base wall 14 interconnecting a pair of side walls 15 which each carries an inwardly directed flange 16 on its edge distal to the base wall 14.

Each of the side walls 12 of the plate 10 is formed along its upper free edge with a plurality of inwardly directed tabs 17, the tabs 17 on opposed sides of the plate 10 being aligned at right angles to the axis of the plate 10 to form aligned pairs of tabs, each tab 17 extending substantially horizontally from the associated side wall 12 and free end portion 18 bent downwardly to lie in a plane parallel to the adjacent side wall 12.

Each stud 11 is formed in each side wall 15 with a longitudinally extending and inwardly extending corrugation 19. Each corrugation has side walls 21 and a base 22, the side walls 21 lie at right angles to side walls 15 and the base 22 lies in a plane parallel to that of the side wall 15.

The plates 10 and studs 11 are preferably formed of 1 mm. steel sheet and the tabs 17 are preferably spaced at a 25 mm pitch. The distance between the base wall 14 and corrugation side wall 21 and the distance between the other corrugation side wall 21 and flange 16 is preferably just less than the space between adjacent tabs 17. The width of the base 22 of the corrugations 19 is preferably just greater than the width of a tab 17. These dimensions will allow the end of each stud 11 to be nested neatly into a plate 10. The corrugations 19 will nest around one of the pairs of tabs 17 while the base wall 14 and the flange 16 will respectively lie in close juxtaposition with tabs on either side of the pair of tab 17 which are nested into the corrugations 19.

Each stud 11 is formed at each end with two rows of aligned apertures 23. The apertures 23 in each row are all spaced an equal distance from the adjacent end of the stud 11 and are formed in the flange 16, the two corrugation side walls 21 and the base wall 14 all closely adjacent the side wall 15. The upper edge of each of the apertures 23 is just above the underside of tabs 17 when the stud 11 is nested into a plate 10.

Locking clips 24 (only the right hand one of which is shown) are used to hold the plates 10 and studs 11 in an assembled condition. Each clip 24 comprises a pin 26 and, extending at right angles to the axis of the pin 26, a flange 25. The pins 26 are arranged to be insertable through the apertures 23 on either side of a stud 11 and to engage against the underside of the tabs 17 on either side of the stud 11 and the tabs 17 nested in the corrugations 19.

In use the end of a stud 11 is nested between appropriate tabs 17 of a plate. The pins 26 of the locking clips 24 are slid through the apertures 23 beneath the tabs 17. The pins 26 force the end of the stud 11 against the base wall 13 of the plate 10 forming a rigid joint therebetween. When an array of parallel studs 11 have been connected to one plate 10 a second plate 10 can be connected to the other end of the studs 11 to complete the wall frame structure.

The connection of the studs 11 to the second plate 10 may take place before or after the pins 26 have been inserted through the aligned apertures 23 at the first end of the studs 11.

As is best seen in FIG. 1 the ends of the side walls 15 of the studs 11 may be provided with a chamfer 27 such that the end edge of the side wall 15 does not engage with the radius between the base wall 13 and the side walls 12 of the plate 10 and prevent the end of the stud 11 bearing cleanly against the base wall 13 of the plate 10.

Figure 3:
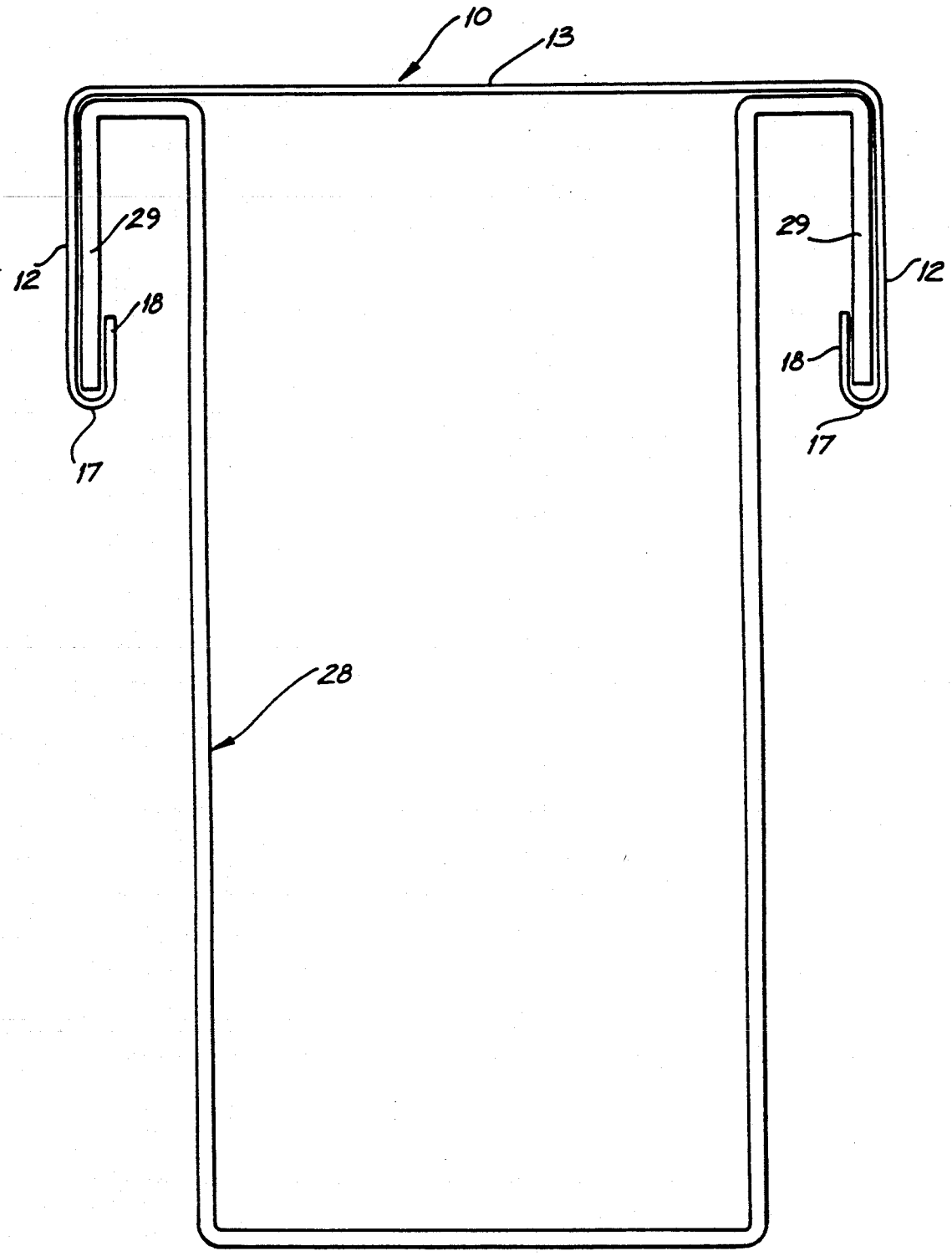
FIG. 3 is a vertical sectional view through a plate adapted to form part of the wall frame structure of FIGS. 1 and 2 in nested relationship with a strengthening beam.

In constructing a wall frame structure according to the present invention it is sometimes necessary to form a supporting beam spanning a window or door aperture. FIG. 3 shows a rolled stud beam member 28 which has been slid longitudinally along a plate 10. The beam member 28 includes downwardly directed flanges 29 which are slidably received between the tabs 17 and the base wall 13 of the plate 10.

Figure 2:
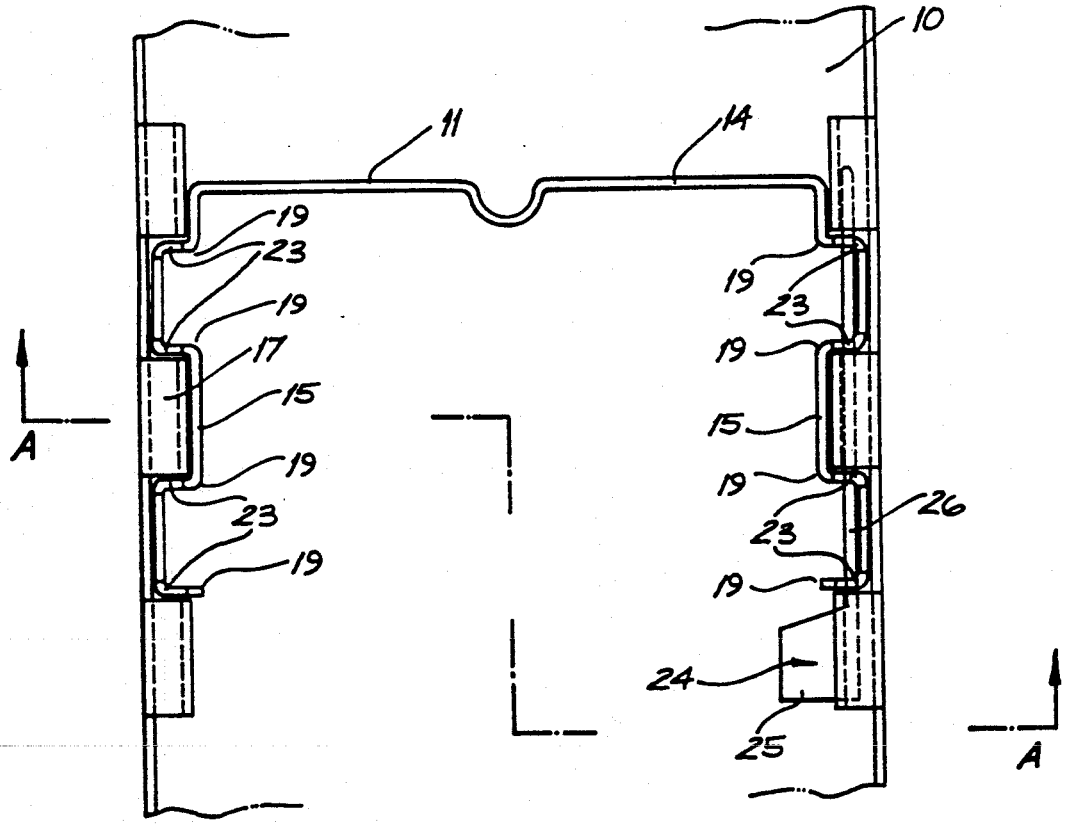
FIG. 2 is a vertical sectional view of the joint shown in FIG. 1 taken along B—B.
Figure 4:
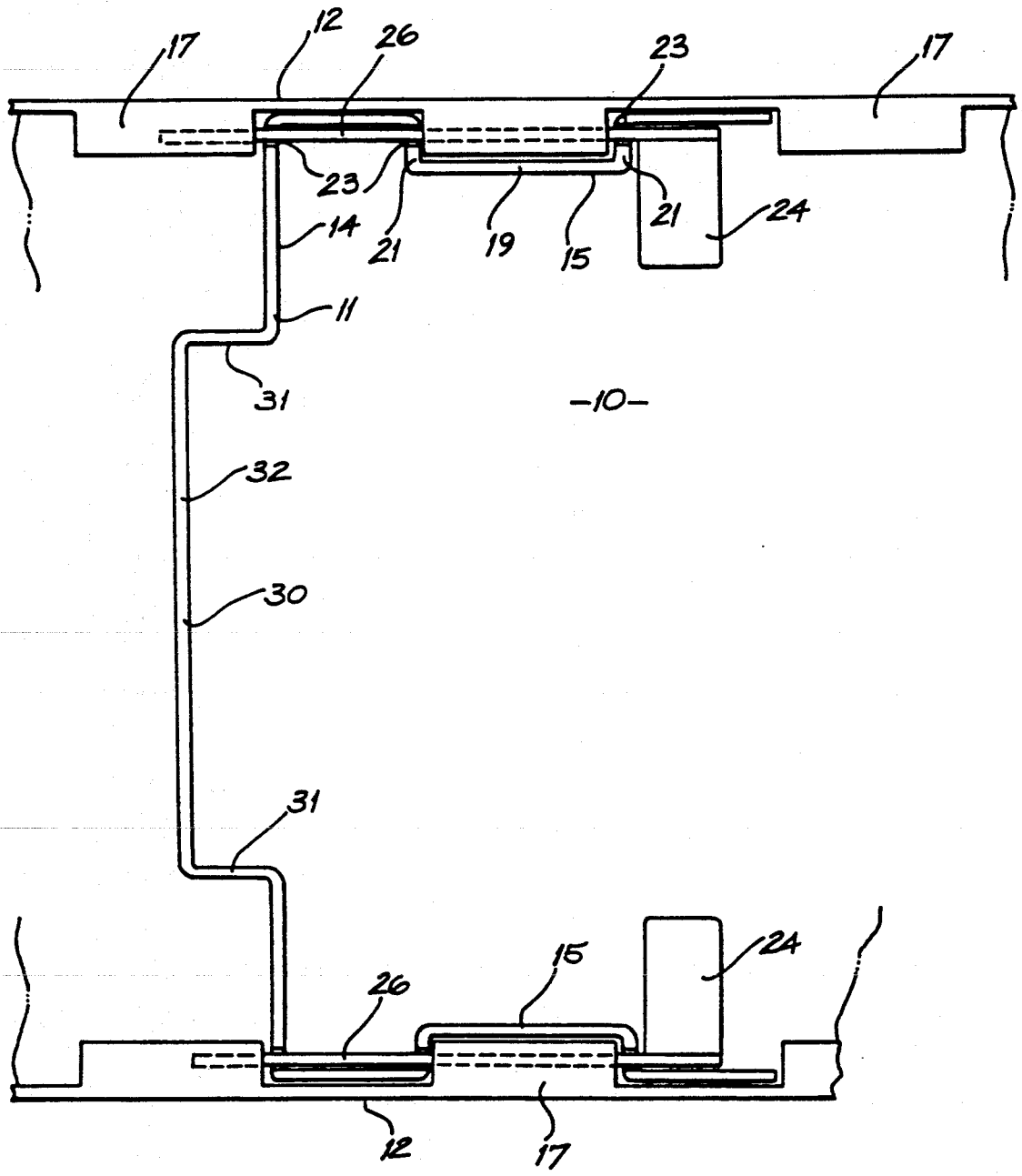
FIG. 4 is a horizontal sectional view of the joint between a stud and a plate forming part of a wall frame according to a further embodiment of the present invention.

The arrangement shown in FIG. 4 is similar to that shown in FIGS. 1 and 2 and similar parts have been given the same identifying numeral. The stud 11 shown in FIG. 4, however, differs from that shown in FIGS. 1 and 2 in that the base wall 14 of the stud 11 shown in FIG. 4 is formed with a longitudinally extending corrugation 30. This corrugation 30 has a pair of side walls 31 and a base 32. The side walls 31 each lies in a plane at right angles to the plane of the base wall 14 while the base 32 lies in a plane parallel to it. The side walls 31 have a width equal to half of the length of a tab 17. This allows two studs 11 to be positioned in back-to-back array.

Figure 5:
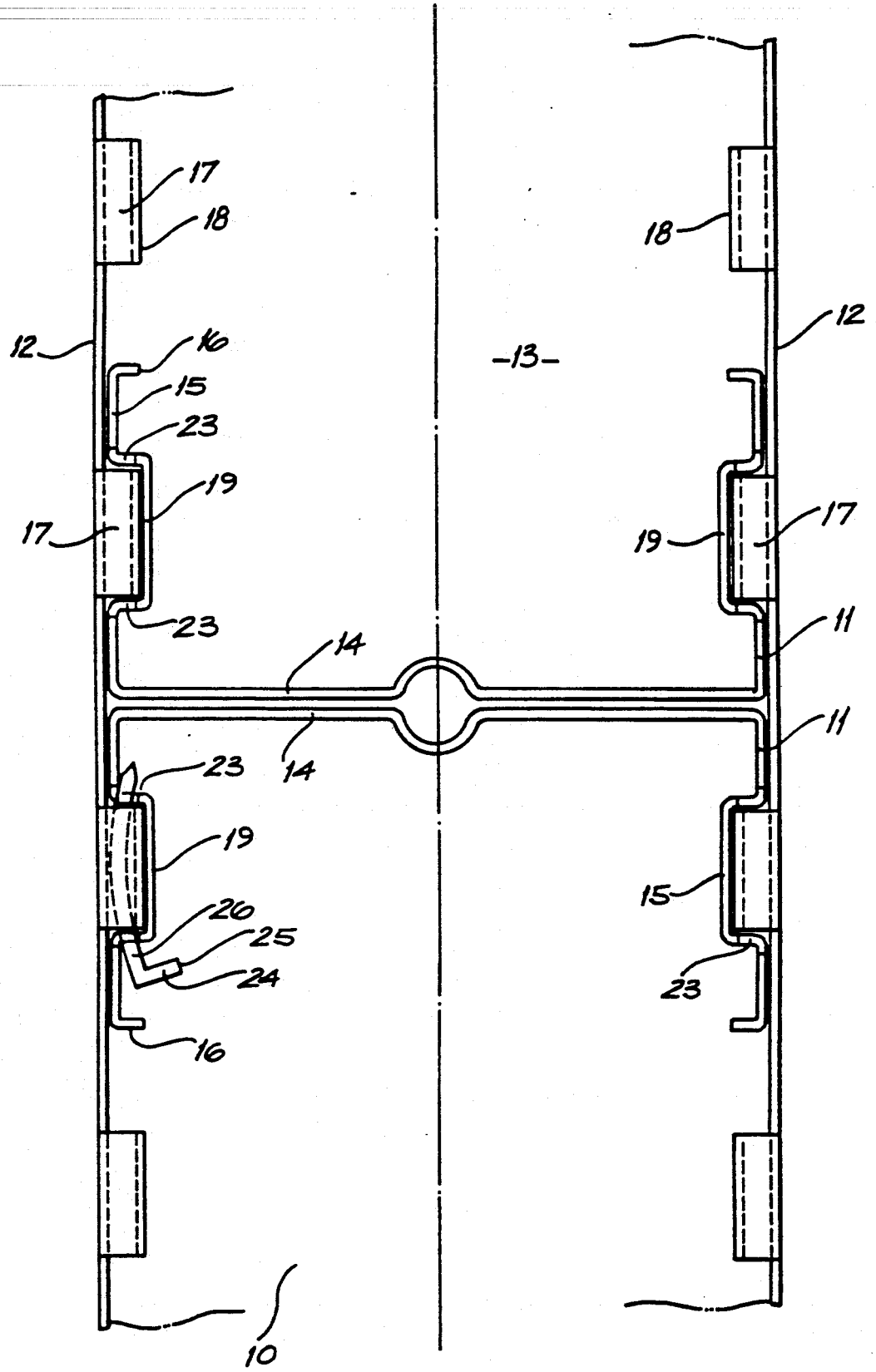
FIG. 5 is a horizontal sectional view of the joint between a stud and a plate forming part of a wall frame according to a still further embodiment of the invention.

The arrangement shown in FIG. 5 is similar to that shown in FIGS. 1 and 2 and similar parts have been given the same identifying numeral. In this arrangement, however, each stud 11 is in contact with only a single pair of tabs 17 which are each nested within one of the corrugations 19 in the side walls of the stud 11. This arrangement allows a pair of studs 11 to be assembled in a back-to-back arrangement as is shown in FIG. 5.

It will be recognised by persons skilled in the art that numerous variations and modifications may be made to the invention as described above without departing from the spirit or scope of the invention as broadly described.

I claim:

1. A metal wall frame structure, comprising:

a horizontally disposed top plate;

a horizontally disposed bottom plate;

a plurality of vertically extending wall studs interconnecting the top and bottom plates; the top and the bottom plates being substantially identical and each being in the form of a generally U-shaped channel having channel side walls, a channel base wall which interconnects the channel side walls, and a plurality of paired inwardly directed tabs arrayed along each of the channel side walls; each of the studs having a generally U-shaped section which has stud side walls and a stud base wall which interconnects the stud side walls and which has a width approximately equal to the spacing between the channel side walls, whereby terminal ends of the studs may be nested within the channels defined by the plates, and wherein each stud is adapted to be nested between two adjacent pairs of tabs or around a single pair of tabs, or both, each stud having adjacent at least one end and adjacent to each side wall at least a pair of apertures aligned transversely to the axis of the stud, and locking means comprising a pin extending through each pair of aligned apertures in the stud and engaging against the side of at least one associated tab proximal to the base wall of the associated plate to urge the said end of the stud into contact with the base wall of the adjacent plate; and wherein each stud is formed, at least adjacent each end, with an inwardly extending longitudinal corrugation, each corrugation being so dimensioned that a tab will neatly nest with the corrugation.

2. A metal wall frame structure as claimed in claim 1 in which the studs are each of C-shaped cross-section with each of the stud side walls carrying, on its edge distal to the base wall, an inwardly directed flange.

3. A metal wall frame structure as claimed in claim 2 in which the aligned apertures in each stud are formed on each side of the stud through the flange and through the base wall of the stud as well as through any intermediate corrugation in the side wall of the stud.

4. A metal wall frame structure as claimed in claim 1 in which the aligned apertures in each stud are formed in each side wall of the stud on either side of the corrugation.

5. A metal wall frame structure as claimed in claim 1 in which each tab extends inwardly from the edge of the associated side wall of a plate and has an end portion turned to point towards the base wall of that plate and to align in a plane substantially parallel to the plane of the associated side wall.

6. A metal wall frame structure as claimed in claim 1 in which each stud is chamfered where the side wall of the stud meets the ends of the stud.

7. A metal wall frame structure as claimed in claim 1 in which the pins are parallel sided and the aligned apertures are all of substantially the same size and form a interference fit with a pin.

8. A metal wall frame structure as claimed in claim 1 in which the pins are tapered or stepped along their length and the aligned apertures diminish in size in the direction of insertion of the pin and form an interference fit with the pin.

9. A metal wall frame structure as claimed in claim 1, wherein each stud is adapted to be nested between two adjacent pairs of tabs.

10. A metal wall frame structure, comprising:

a horizontally disposed top plate;

a horizontally disposed bottom plate;

a plurality of vertically extending wall studs interconnecting the top and bottom plates; the top and the bottom plates being substantially identical and each being in the form of a generally U-shaped channel having channel side walls, a channel base wall which interconnects the channel side walls, and a plurality of paired inwardly directed tabs arrayed along each of the channel side walls; each of the studs having a generally U-shaped section which has stud side walls and a stud base wall which interconnects the stud side walls and which has a width approximately equal to the spacing between the channel side walls, whereby terminal ends of the studs may be nested within the channels defined by the plates, and wherein each stud is adapted to be nested around a single pair of tabs, each stud having adjacent at least one end and adjacent to each side wall at least a pair of apertures aligned transversely to the axis of the stud, and locking means comprising a pin extending through each pair of aligned apertures in the stud and engaging against the side of at least one associated tab proximal to the base wall of the associated plate to urge the said end of the stud into contact with the base wall of the adjacent plate.

* * * * *